US005757342A

United States Patent [19]

Hayashi

[11] Patent Number: 5,757,342

[45] Date of Patent: May 26, 1998

[54] PLASMA ADDRESSED LIQUID CRYSTAL DISPLAY DEVICE

[75] Inventor: Masatake Hayashi, Kanagawa, Japan

[73] Assignee: Sony Corporation, Tokyo, Japan

[21] Appl. No.: 396,817

[22] Filed: Mar. 2, 1995

[30] Foreign Application Priority Data

Mar. 7, 1994 [JP] Japan ..... 6-036058

[51] Int. Cl.[6] ..... G09G 3/36; G09G 3/28; G09G 3/00

[52] U.S. Cl. ..... 345/60; 345/87; 345/94

[58] Field of Search ..... 345/60, 209, 158, 345/145, 156, 89, 87, 63, 84, 94, 96, 208, 204

[56] References Cited

U.S. PATENT DOCUMENTS

| | | | |
|---|---|---|---|
| 3,755,027 | 8/1973 | Gilsing | 313/491 |
| 3,894,264 | 7/1975 | Andoh et al. | 345/71 |
| 4,048,533 | 9/1977 | Hinson et al. | 313/486 |
| 4,196,432 | 4/1980 | Chihara | 345/209 |
| 4,396,941 | 8/1983 | Nishimura et al. | 345/156 |
| 4,488,179 | 12/1984 | Krüger et al. | 345/158 |
| 4,698,664 | 10/1987 | Nichols et al. | 345/145 |
| 4,896,149 | 1/1990 | Buzak | 345/60 |
| 5,077,553 | 12/1991 | Buzak | 345/87 |
| 5,107,182 | 4/1992 | Sano et al. | 313/485 |
| 5,164,633 | 11/1992 | Kim et al. | 313/581 |
| 5,182,489 | 1/1993 | Sano | 313/489 |
| 5,272,472 | 12/1993 | Buzak | 345/60 |
| 5,349,454 | 9/1994 | Iwama | 345/60 |
| 5,408,226 | 4/1995 | Kwon | 345/60 |
| 5,408,245 | 4/1995 | Kakizaki | 345/60 |
| 5,420,707 | 5/1995 | Miyazaki | 345/60 X |
| 5,453,660 | 9/1995 | Martin et al. | 345/60 |
| 5,506,599 | 4/1996 | Iwana | 345/90 |
| 5,519,520 | 5/1996 | Stoller | 345/89 X |
| 5,523,770 | 6/1996 | Tanamachi | 345/60 |
| 5,525,862 | 6/1996 | Miyazaki | 345/60 X |
| 5,592,193 | 1/1997 | Chen | 345/88 |
| 5,657,035 | 8/1997 | Miyazaki | 345/87 |

OTHER PUBLICATIONS

U.S. application No. 08/242,235, Hironobu, filed May 13, 1994.

U.S. application No. 08/260,666, Miyazaki, filed Feb. 20, 1992.

*Primary Examiner*—Kee M. Tung
*Assistant Examiner*—John Suraci
*Attorney, Agent, or Firm*—Hill, Steadman & Simpson

[57] ABSTRACT

A plasma addressed liquid crystal display device which includes a flat panel composed of a liquid crystal cell having signal electrodes in a column superposed on a plasma cell having discharge channels in a row. The discharge channel includes a pair of discharge electrodes for generating a plasma discharge therebetween; a scan control circuit for generating a strobe pulse for selecting the discharge channel; means for providing a first voltage pulse having one polarity with respect to a reference potential to one of the pair of electrodes; a constant current circuit for maintaining a discharge current at a constant level during discharge selection period; and driving means for providing a second voltage pulse to the other of the pair of the electrodes, the second voltage pulse having an initial potential of reversed polarity of the one polarity at the start of the discharge selection period, the potential decrementing with the lapse of time and returning to the reference potential before the end of the discharge selection period.

20 Claims, 6 Drawing Sheets

PLASMA ADDRESSED LIQUID CRYSTAL DISPLAY DEVICE

FIELD OF THE INVENTION

This invention relates to a plasma addressed liquid crystal display device and more particularly a picture display device wherein an electro-optic material layer using plasma to select pixels is provided.

BACKGROUND OF THE INVENTION

As the picture display device for driving liquid crystal, a plasma addressed liquid crystal display device using discharge plasma is disclosed in, for example, U.S. Pat. No. 4,896,149 to Buzak (Issue date: Jan. 23, 1990, U.S. Pat. No. 5,077,553 to Buzak (Issue date: Dec. 12, 1990) and U.S. patent application Ser. No. 07/837,961 for an Electro Optical Device, filed by Shigeki Miyazaki on Feb. 20, 1990. The disclosure of the three above noted references is hereby incorporated herein.

Previously proposed plasma addressed liquid crystal display device typically require a greater deal of power to operate. Further, the costs associated with circuitry capable of driving the plasma addressed liquid crystal display device are typically increased due to the high power requirements.

There has been previously proposed a plasma addressed liquid crystal (PALC) display device having a flat panel structure composed of a liquid crystal cell having signal electrodes in a column superposed upon a plasma cell having discharge channels in a row with an intermediate glass thin plate, or sheet, provided between the cells. The plasma cell on the lower side is used for addressing the liquid crystal cell on the upper side. That is, the plasma cell is connected with a scanning circuit, which applies a strobe pulse line-sequentially to each of the discharge channels. Each discharge channel includes a pair of anode and cathode. The liquid crystal cell is connected with a driving circuit, which applies a driving voltage to the signal electrodes synchronously with line-sequential selection of the scanning circuit.

The structure of this previously proposed plasma addressed liquid crystal display unit will be briefly described with reference to FIGS. 1 and 2.

The plasma addressed liquid crystal display unit has a first substrate 21 which is flat and sufficiently optically transparent, a second substrate 22 which is also flat and transparent, and a liquid crystal layer 23 as an electro-optic material layer inserted between the first and second substrates 21, 22, with a space between the liquid crystal layer 23 and the substrate 22 defined as a discharge region 24. For example, in the case of the transparent display device, the first substrate 21 and the second substrate 22 are composed of a non-conductive and optically transparent material. The first substrate 21 has plural band-shaped electrodes 25 formed on its one major surface 21*a*, and the liquid crystal layer 23 composed of a nematic liquid crystal or the like is provided in contact with the electrodes 25. The liquid crystal layer 23 is narrowly supported between the first substrate 21 and a thin dielectric film 26 composed of glass, mica, plastic or the like. Thus, the first substrate 21, the liquid crystal layer 23 and the dielectric film 26 form the so-called liquid crystal cell. The dielectric film 26 functions as an insulating cut-off layer between the liquid crystal layer 23 and the discharge region 24.

On the other hand, the second substrate 22 has plural discharge electrodes 27 formed in a band shape. With the periphery of the discharge electrodes 27 supported with a sealant, the second substrate 22 is provided at a predetermined distance from the dielectric film 26. The space between the second substrate 22 and the dielectric film 26 is defined as the discharge region 24 for generating discharge plasma. The discharge region is partitioned by the sealant, that is, plural barrier ribs 29, into separate plasma chambers $P_1, P_2, \ldots, P_n$. Each of the plasma chambers $P_1, P_2, \ldots, P_n$ is filled with an ionizable gas, such as, helium, neon, argon, or a mixed gas thereof.

The barrier ribs 29 are formed in parallel with and between the discharge electrodes 27, that is, every scanning unit. Therefore, the plasma chambers $P_1, P_2, \ldots, P_n$ correspond to scanning lines. The barrier ribs 29 are formed by printing, for example, by stack-printing glass paste for several times by screen printing. The barrier ribs 29 also function to control the space of the discharge region 24, that is, the distance between the second substrate 22 and the dielectric film 26. The distance between the second substrate 22 and the dielectric film 26 can be controlled by adjusting the number of screen printing and the amount of the glass paste in each printing. The distance between the second substrate 22 and the dielectric film 26 is normally set to approximately 200 μm.

The discharge electrodes 27 formed within each of the plasma chambers $P_1, P_2, \ldots, P_n$ can be formed directly on the second substrate 22, for example, by printing conductive paste containing silver powder. The discharge electrodes 27 may also be formed by etching process. In either case, the discharge electrodes 27 can be formed on a plane, and hence in a simple manner with satisfactory dimensional precision. Therefore, in manufacturing, first the discharge electrodes 27 and then the barrier ribs 29 are formed on the plane second substrate 22.

As is described above, electrodes for driving the liquid crystal layer 23 are formed on the first substrate 21 and the second substrate 22. The band-shaped electrodes 25 formed with a predetermined width on the major surface 21*a* of the first substrate 21 facing the second substrate 22 are composed of a transparent conductive material, such as, indium tin oxide (ITO) and are optically transparent. The electrodes 25 are arrayed in parallel with one another, and perpendicularly to the screen, for example. On the other hand, the discharge electrodes 27 are formed on the major surface 22*a* of the second substrate 22 facing the first substrate 21. These discharge electrodes 27 are linear electrodes parallel to one another, which are arrayed in a direction orthogonal to the electrodes 25 formed on the first substrate 21. That is, these discharge electrodes 27 are arrayed horizontally to the screen. Also, each of the discharge electrodes 27 is composed of an anode electrode and a cathode electrode. The pair of anode and cathode electrodes forming the discharge electrode is formed within each of the plasma chambers $P_1, P_2, \ldots, P_n$.

A potential difference of approximately 300V between anode and cathode is required for uniformly carrying out plasma discharge on the entire screen in the plasma addressed liquid crystal display device. FIG. 3 shows relation between the potential of cathode and time. In the case of driving the potential as it is, a corresponding high pressure-resistant driving circuit is required, thus raising costs associated with utilizing the PALC display device.

SUMMARY OF THE INVENTION

In view of the above-described short comings of previously proposed PALC display devices, it is an object of the present invention to provide a plasma addressed liquid display device capable of reducing costs for the driving circuit and limiting power consumption.

According to the present invention, there is provided a plasma addressed liquid crystal display device which includes a flat panel composed of a liquid crystal cell having signal electrodes in a column superposed on a plasma cell having discharge channels in a row, the discharge channel includes a pair of discharge electrodes for generating a plasma discharge there between; a scan control circuit for generating a strobe pulse to select the discharge channels; a unit for providing a first voltage pulse having one polarity with respect to a reference potential to one of said pair of electrodes on the basis of the strobe pulse from the scan control circuit; a constant current circuit for maintaining a discharge current at a constant level during discharge selection period; and a driving unit for providing a second voltage pulse to the other of said pair of electrodes, the second voltage pulse having an initial potential of reversed polarity of said one polarity at the start of the discharge selection period, the potential decrementing with the lapse of time and returning to the reference potential before the end of the discharge selection period.

Also, in the plasma addressed liquid crystal display device of the present invention, the one discharge electrode and the other discharge electrode may be caused to function as cathode and anode, respectively, and the cathode may be provided with the negative-going first voltage pulse, with the initial potential being higher than the reference potential.

According to the present invention, there is also provided a discharge driving circuit which includes a plurality of nonintersecting channels filled with an ionizable gas, each channel containing a pair of discharge electrodes; a scan control circuit for generating a strobe pulse for selecting discharge channels; a unit for providing a first voltage pulse having one polarity with respect to a reference potential to one of said pair of electrodes; a constant current circuit for maintaining a discharge current at a constant level during discharge selection period; and a unit for providing a second voltage pulse to the other of said pair of electrodes, the second voltage pulse having an initial potential of reversed polarity of said one polarity at the start of the discharge selection period, the potential decrementing with the lapse of time and returning to the reference potential before the end of the discharge selection period.

DESCRIPTION OF THE PREFERRED EMBODIMENTS

The operation of the plasma addressed liquid crystal display device will be first described to provide backgrounds of the present invention.

Figure 12:
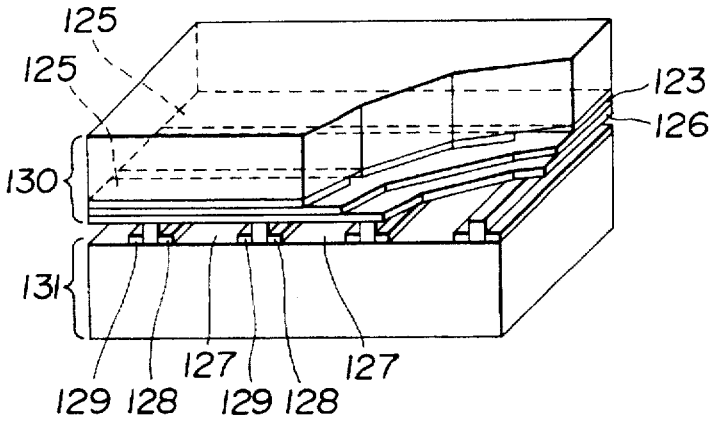
FIG. 12 is a diagram illustrating the present invention.
Figure 13:
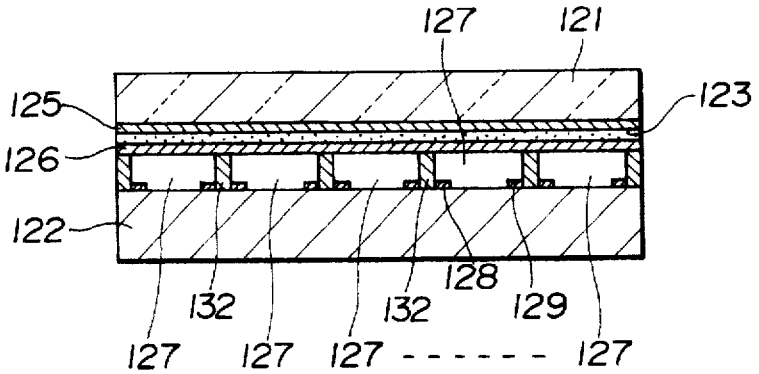
FIG. 13 is a diagram illustrating the present invention.

With reference to FIG. 12 and FIG. 13 it can be seen that there is provided a Plasma Cell 131 which is superposed on a liquid crystal cell 130. Plasma cell 131 includes a substrate 122, a plurality of cathodes 129, a plurality of anodes 128 which are located to either side of a plurality of plasma channels (discharge channel) 127. Cathode 129 and anode 128 are separated by a barrier rib 132. Liquid crystal cell 130 includes a substrate 121, a plurality of signal electrodes 125 and a dielectric film 126.

Signal electrode 125 of liquid crystal cell 130 constituting a column (vertical line) are provided with a driving voltage (data voltage) of polarity reversed against the anode potential every frame or every line of a displayed picture. In discharge channels 127 of plasma cell 131 forming a row (horizontal line), plasma discharge which is formed between anode 128 and cathode 129 is generated line-sequentially. Consequently, a potential substantially equal to that of anode 128 is generated on the lower surface of an intermediate dielectric film 126, such as, a glass thin plate, or sheet, during or immediately after discharge. During this operation, a potential difference is generated between the signal electrodes and the lower surface of the glass thin plate. Thus, liquid crystal molecules change in arrangement and the amount of light permeating the liquid crystal cell 130 changes, in response to the effective value of the potential difference. The effective value is divided in response to a ratio of the capacity of liquid crystal capacity to the capacity of the glass sheet 126 thin plate. Thus, transmittance of light passing through the liquid crystal cell 130 can be controlled in accordance with the difference between the potential provided to the signal electrodes and the anode potential. The potential difference between the signal electrodes 125 and the lower surface of the glass sheet 126 is maintained and the liquid crystal cell 130 maintains the transmittance until plasma discharge is generated in the next frame, unless leak of electric charge is generated in the liquid crystal cell 130 or the intermediate glass sheet 126.

As is described above, a high potential difference between anode and cathode is required for uniformly carrying out plasma discharge on the entire screen. Therefore, a high pressure-resistant driving circuit is required.

Figure 1:
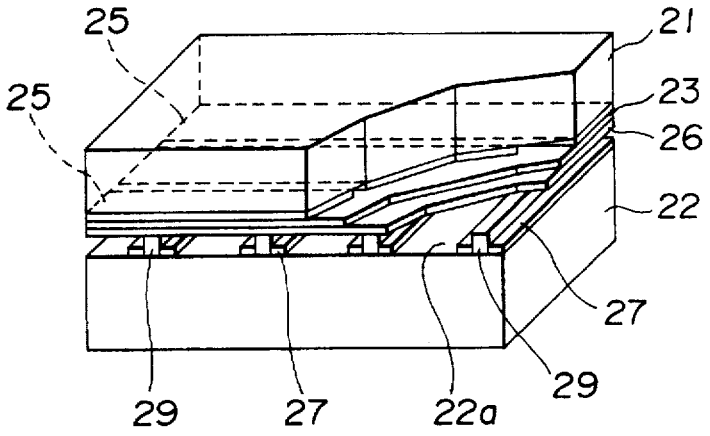
FIG. 1 is a view showing the structure of a conventional plasma addressed liquid crystal display device.
Figure 2:
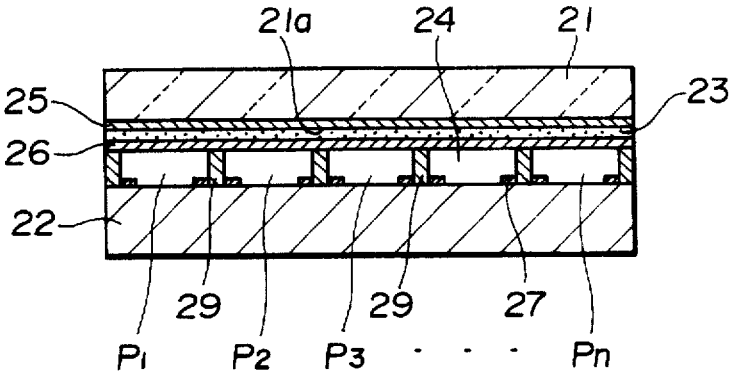
FIG. 2 is a cross-sectional view showing the conventional plasma addressed liquid crystal display device.
Figure 3:
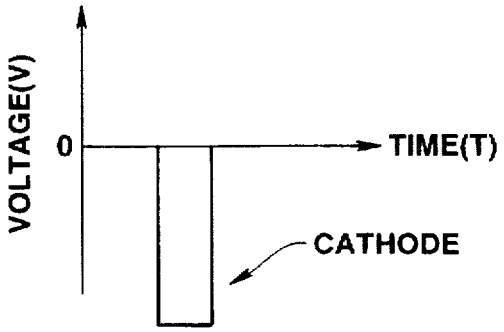
FIG. 3 shows relation between cathode potential in discharge and time.
Figure 4:
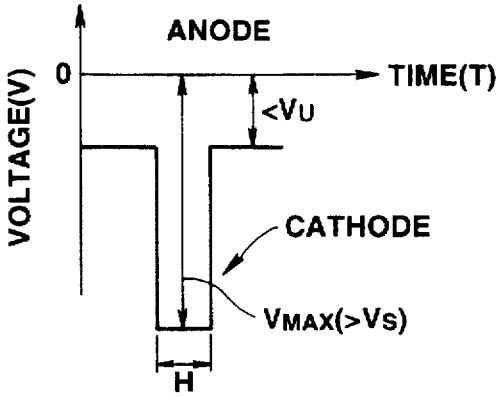
FIG. 4 shows relation between potentials of anode and cathode and time.

To meet this requirement, a typical technique of adding an extra voltage for driving a plasma display panel (PDP) between a voltage VU lower than the voltage at which plasma discharge stops completely and a voltage VS for starting plasma discharge on the entire screen is conventionally used. In this case, the maximum potential difference VMAX between anode and cathode is set to a greater value than the voltage VS for starting discharge on the entire screen. FIG. 4 shows relation between potentials of anode and cathode and time in the case where this technique is used in the plasma addressed liquid crystal display device. In this case, a voltage undesirable, or too great, for liquid crystal may be applied because the cathode potential and the anode potential differ at the end of discharge selection period H.

Figure 5:
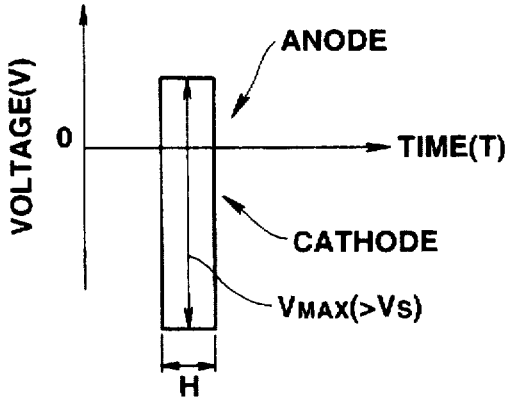
FIG. 5 shows another relation between potentials of anode and cathode and time.

Also, another technique of driving anode simultaneously with cathode during the discharge selection period H may be employed. FIG. 5 shows relation between potentials of anode and cathode and time in the case where this technique is used in the plasma addressed liquid crystal display device. In this case, cathode and anode must be driven precisely at high speed at the end of the discharge selection period H. However, it is difficult to set the timing to drive cathode and anode precisely at high speed. When cathode and anode cannot be driven precisely at high speed, a potential undesirable for liquid crystal may be applied, thus resulting in damage to the LCD. This problem is more conspicuous in a structure in which plural anodes are driven in common.

Figure 6:
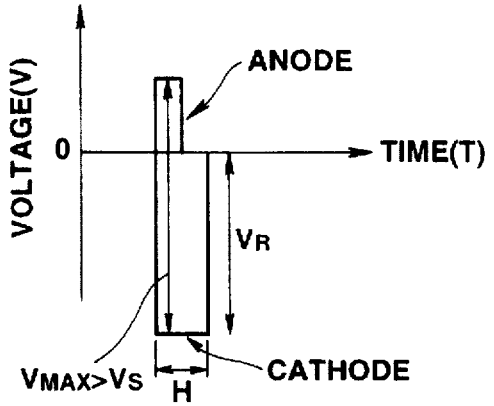
FIG. 6 shows still another relation between potentials of anode and cathode and time.

In addition, still another technique utilizing discharge characteristics as described below may be employed. That is, as shown in FIG. 6, a voltage $V_R$ for maintaining plasma discharge is significantly lower than the voltage $V_s$ for starting discharge on the entire screen, and therefore drives anode only in a period at the start of the discharge selection period H. The maximum difference $V_{MAX}$ between anode and cathode is set to a greater value than the voltage $V_S$ for starting discharge on the entire screen. Consequently, only cathode is driven at the end of discharge. The above-described problem is thus solved.

In this case, however, the following problem is raised. A load resistor or a constant current circuit must be provided in the discharge current path to limit the discharge current. Therefore, the actual voltage between anode and cathode is as indicated by broken lines in FIGS. 7 and 8.

Figure 7:
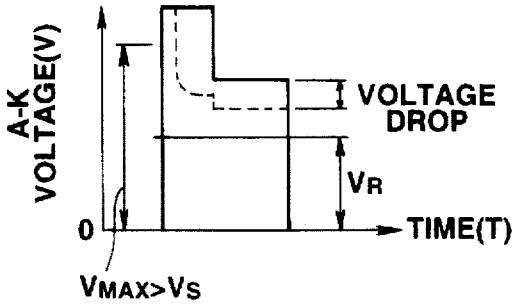
FIG. 7 shows relation between A–K voltage and time with the use of a load resistor.
Figure 8:
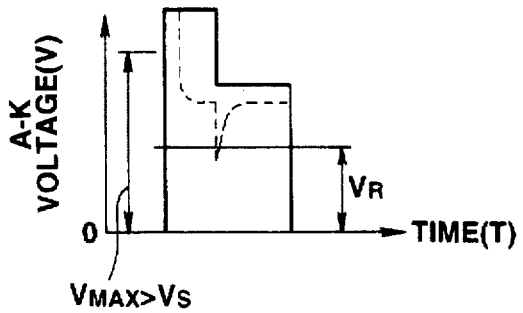
FIG. 8 shows relation between A–K voltage and time with the use of a constant current circuit.

FIG. 7 shows relation between the voltage between anode and cathode, that is, so-called A–K voltage, and time in the case where a load resistor is provided. The driving amplitude of cathode must be set to be higher than the voltage $V_R$ for maintaining discharge by the amount of voltage drop of the load resistor or greater. Accordingly, the effect of reduction in driving amplitude of cathode due to driving of anode is diminished. FIG. 8 shows relation between the A–K voltage and time in the case where a constant current circuit is provided. In this case, it is ideally possible to reduce the driving amplitude of cathode to a level equal to the voltage $V_R$ for maintaining discharge. Actually, however, the voltage between anode and cathode exhibits a waveform as indicated by a broken line in FIG. 8 because of delay in feedback by the constant current circuit. That is, at the moment when the voltage of anode is lowered, the voltage at both ends of the constant current circuit must be lowered with the same amplitude. Actually, however, delay of, for example, 0.1 μsec causes a reduction in the A–K voltage, thus halting discharge. Then, as a voltage greater than the voltage VS for starting discharge is not applied between anode and cathode, plasma discharge does not start. Therefore, to maintain plasma discharge, it is necessary to estimate the amount of voltage drop and set the driving amplitude of cathode to a value significantly greater than the voltage VR for maintaining discharge.

Thus, in the device according to the present invention, a voltage having one polarity is applied to one of the discharge electrodes. After the voltage of the other of the discharge electrodes is raised simultaneously with or shortly after the voltage application to the one discharge electrode, the voltage is gradually lowered with the lapse of time by a constant decrement value. Thus, the discharge current is maintained at a constant level.

Figure 9:
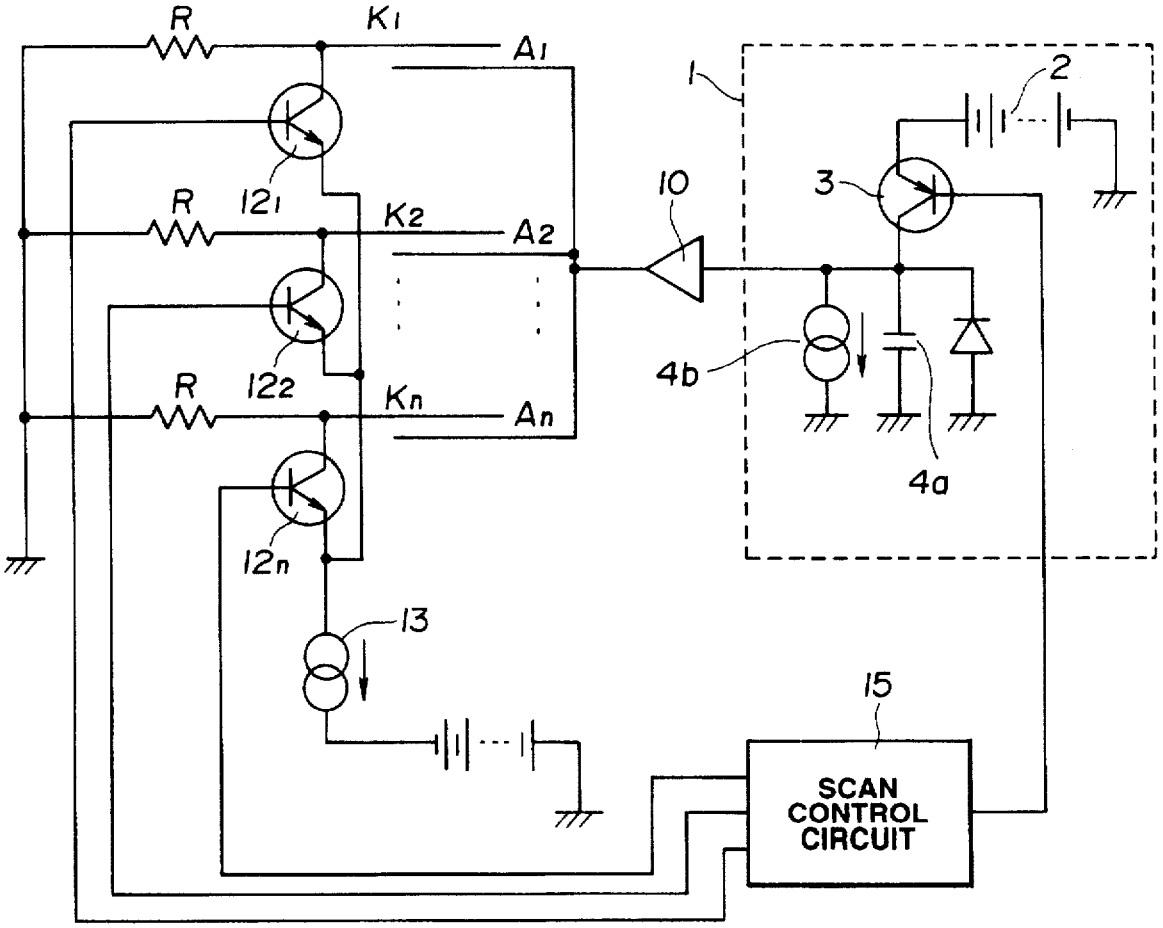
FIG. 9 is a view showing the structure of a driving circuit of the plasma addressed liquid crystal display device.

A preferred embodiment of the present invention will now be described with reference to FIGS. 9, 10A, 10B and 10c. FIG. 9 shows the structure of a discharge driving circuit of the discharge electrodes formed on the second substrate of the plasma addressed liquid crystal display device of the present invention.

Cathodes $K_1, K_2, \ldots, K_n$ are connected to grounded resistors R, respectively, and are connected through collectors and emitters of transistors $12_1, 12_2, \ldots 12_n$, respectively, to a constant current circuit 13. Bases of the transistors $12_1, 12_2, \ldots 12_n$ are connected to a scan control circuit 15. The scan control circuit 15 sequentially generates a strobe pulse corresponding to the scanning timing on the screen(72 hz, for example), and sequentially supplies the strobe pulse to the transistors $12_1, 12_2, \ldots 12_n$. The cathodes $K_1, K_2, \ldots, K_n$ carry out plasma discharge sequentially in accordance with the strobe pulse.

Figure 10A:
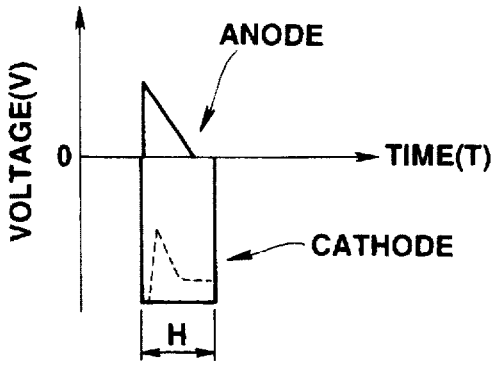
FIG. 10A shows a relation between potentials of anode and cathode and time.

Specifically, the transistor supplied with the strobe pulse of the transistors $12_1$, to $12_n$ (hereinafter referred to simply as the transistor 12) is on during a period in which one cathode (hereinafter referred to simply as the cathode) is selected from the cathodes $K_1$ to $K_n$ on the basis of the strobe pulse, that is, during the discharge selection period H. The constant current circuit 13 causes a constant current to flow through the transistor 12. Thus, the potential of the cathode $K_1$ to $K_n$ is maintained at a level lower than the ground potential (0V), the reference potential, during the discharge selection period H, and is returned to the reference potential at the end of the discharge selection period H, as shown in FIG. 10A.

At the start of the discharge selection period H, a pulse signal of shorter duration than the strobe pulse is transmitted from the scan control circuit 15 to a control circuit 1 for the anode applied voltage. The voltage outputted from the control circuit 1 is applied through an output amplifier 10 to anodes $A_1, A_2, \ldots, A_n$.

Specifically, a transistor 3 within the control circuit 1 is on during a period/time duration shorter than the strobe pulse, simultaneously or shortly after the start of driving of cathode $K_1$ to $K_n$, on the basis of the pulse signal from the scan control circuit 15. Thus, the anode potential is raised to a predetermined potential above, or below, the reference potential (0v), as shown in FIG. 10A. On the assumption that the voltage of a dc power source is set to 100V, when the transistor 3 is on, the voltage of 100V is applied through the transistor 3 to a capacitor 4*a*, thus charging the capacitor 4*a* to have a voltage of 100V. The voltage is applied to anode $A_1, A_2, \ldots, A_n$ through the output amplifier 10. When the transistor 3 is then turned off, the charge stored in the capacitor 4*a* is discharged through a current source 4*b*. The voltage of the capacitor 4*a* is lowered with a constant inclination by the current source $4_b$, and returns to the reference potential (0v) before the end of the discharge selection period H. That is, the control circuit 1 generates a voltage having substantially a triangular or sawtooth waveform, and applies this voltage to anode $A_1, A_2, \ldots, A_n$.

That is, the voltage initially stored in the capacitor 4*a* is transmitted to anode through the output amplifier 10, raising the anode potential to 100V. Consequently, the potential between one electrode selected from the cathodes and one electrode of the anodes corresponding to the selected cathode is higher than the voltage $V_S$ for starting discharge on the entire screen, thus starting discharge. The maximum potential difference $V_{MAX}$, between anode and cathode is set to a level higher than the voltage $V_S$ for starting discharge on the entire screen. Then, the anode potential is lowered with the lapse of time by the current source 4b. In this case, the voltage pulse of anode is lowered gradually, not quickly, and the anode potential is lowered to the reference potential before the end of the discharge selection period H. Meanwhile, when the voltage is applied to anode, the cathode potential is controlled by the constant current circuit 13 so that the discharge current is constant, as indicated by a broken line in FIG. 10A.

Figure 10B:
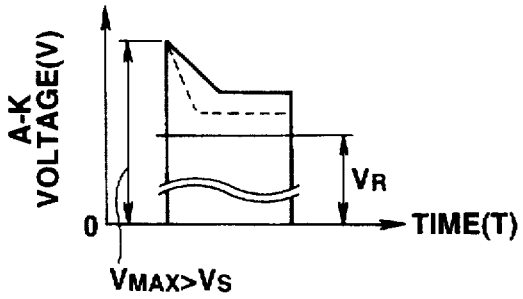
FIG. 10B shows a relation between potentials of anode and cathode and time.

FIG. 10B shows relation between the voltage between anode and cathode and time in the plasma addressed liquid crystal display device of the present invention. The actual voltage between anode and cathode is as indicated by a broken line in FIG. 10B.

That is, by lowering the voltage pulse of anode gradually, not quickly, as shown in FIG. 10B, the constant current circuit 13 can lower the voltage at both ends thereof, that is, the constant current circuit 13 can satisfactorily follow the change in anode voltage, even when the delay exists in feedback control by the constant current circuit 13. Thus, in the plasma addressed liquid crystal display device according to the present invention, the problems of reduction in voltage between anode and cathode during discharge and the resulting halt of plasma discharge are not generated, unlike the conventional device having the constant current circuit provided in the discharge current path. Accordingly, in the plasma addressed liquid crystal display device according to the present invention, setting the driving amplitude of cathode to a greater value than the voltage $V_R$ for maintaining discharge in consideration of the voltage drop of the load resistor is not necessary, unlike the conventional device having the load resistor provided in the discharge current path. That is, in the plasma addressed liquid crystal display device according to the present invention, the reduction in driving amplitude of cathode due to driving of anode is not lowered.

Figure 11:
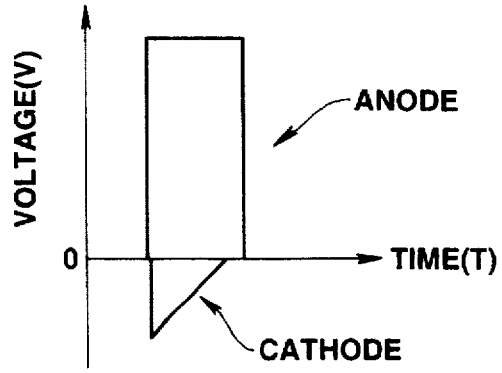
FIG. 11 shows another relation between potentials of anode and cathode and time.

In the above embodiment, the cathode side is described as the basic control electrode. However, it is possible to exchange anode and cathode, and reverse the polarities entirely to cause the anode side to function as the basic control electrode. FIG. 11 shows relation between potentials of anode and cathode and time in this case. By entirely reversing the polarity of anode and the polarity of cathode, driving the anode side as the control electrode exhibits results similar to those in the case where cathode is used as the control electrode.

As is clear from the above description, in the plasma addressed liquid crystal display device of the present embodiment, the voltage pulse of high voltage having one polarity with respect to the reference potential is provided to one of the discharge electrodes for causing plasma discharge to be carried out, so that the discharge electrode is selectively discharged. At the start of the discharge selection period when the one discharge electrode is selectively discharged, the potential to be provided to the other discharge electrode corresponding to the one discharge electrode is set to a predetermined potential of reversed polarity of the one polarity. By decrementing the set potential with the lapse of time and returning the potential to the reference potential before the end of the discharge selection period, the driving amplitude of cathode driven in response to the discharge electrode can be reduced. Therefore, costs for the driving circuit and hence power consumption can be reduced. In addition, since extraordinary offset or the like is not applied to the liquid crystal, the quality of displayed picture and reliability of liquid crystal can be improved.

By locating the one and the other discharge electrodes in response to the scanning lines in the direction thereof, the driving amplitude of cathode driven in accordance with the discharge electrodes can be reduced.

In addition, when the one discharge electrode is cathode and the other discharge electrode is anode, by providing the negative-going discharge voltage pulse to the cathode and providing a potential higher than the reference potential to the anode, the driving amplitude of the cathode driven in response to the discharge electrodes can be reduced.

It will be appreciated that the present invention can be embodied as a video playback device, such as a television, video tape player, optical video disk player or the like. Further, it will be appreciated that the present invention may be easily adapted for use in, for example, a personal computer system, computing device or the like.

In view of the above description of the present invention, it will be appreciated by those skilled in the art that many variations modifications and changes can be made to the present invention without departing from the spirit or scope of the present invention as defined by the appended claims hereto. All such variations, modifications or changes are fully contemplated by the present invention.

What is claimed is:

1. A plasma addressed liquid crystal display device, comprising:

a flat panel composed of a liquid crystal cell having signal electrodes in a column superposed on a plasma cell having discharge channels in a row, said discharge channel including a pair of discharge electrodes for generating a plasma discharge therebetween;

a scan control circuit for generating a strobe pulse for selecting the discharge channel; means for providing a first voltage pulse having one polarity with respect to a reference potential to one of the pair of discharge electrodes in the plasma cell;

a constant current circuit for maintaining a plasma discharge current at a constant level during a discharge selection period; and driving means for providing a second voltage pulse to the other of the pair of the discharge electrodes, the second voltage pulse having an initial potential of reversed polarity of the one polarity at the start of the discharge selection period so that a plasma discharge is initiated between the pair of discharge electrodes at the start of the discharge selection period, the potential decrementing over time and returning to the reference potential before the end of the discharge selection period so that the voltage between the pair of discharge electrodes is of a lesser amplitude than the initial potential and is sufficient to maintain the plasma discharge.

2. The plasma addressed liquid crystal display device as claimed in claim 1, wherein the reference potential is a ground potential.

3. The plasma addressed liquid crystal display device as claimed in claim 1, further comprising an amplifier between the other discharge electrode and the driving means.

4. The plasma addressed liquid crystal display device as claimed in claim 1, further comprising:

a data driving circuit for applying a driving voltage to the signal electrodes synchronously with line-sequential selection of the discharge channels.

5. The plasma addressed liquid crystal display device as claimed in claim 1, wherein the other discharge electrode is connected in common.

6. The plasma addressed liquid crystal display device as claimed in claim 1, wherein the liquid crystal cell is composed of a first substrate having the signal electrode formed on an inner surface thereof, a dielectric sheet spaced from the first substrate, and a liquid crystal layer between the first substrate and the dielectric sheet.

7. The plasma addressed liquid crystal display device as claimed in claim 6, wherein the plasma cell is composed of a second substrate provided to face the first substrate, the dielectric sheet, and an ionizable gas sealed between the second substrate and the dielectric sheet.

8. The plasma addressed liquid crystal display device as claimed in claim 7, wherein said pair of discharge electrodes extend along a surface portion of the second substrate facing said first substrate.

9. The plasma addressed liquid crystal device comprising:

a flat panel composed of a liquid crystal cell having signal electrodes in a column superposed on a plasma cell having discharge channels in row, said discharge channel including a pair of discharge electrodes for generating a plasma discharge therebetween;

a scan control circuit for generating a strobe pulse for selecting the discharge channel;

means for providing a first voltage pulse having one polarity with respect to a reference potential to of the pair of discharge electrodes in the plasma cell;

a constant current circuit for maintaining a plasma discharge current at a constant level during a discharge selection period; and driving means for providing a second voltage to the other of the pair of the discharge electrodes, the second voltage pulse having an initial potential of reversed polarity of the one polarity at the start of the discharge selection period, the potential decrementing over time and returning to the reference potential before the end of the discharge selection period, wherein one of said pair of discharge electrodes and other of said pair of discharge electrode are cathode and anode, respectively, the cathode provided with the first voltage pulse which is negative-going, the initial potential being than the reference potential.

10. The plasma addressed liquid crystal display device, comprising:

a flat panel composed of a liquid cell having signal in a column superposed on a plasma cell having discharge channel in a row, said discharge channel including a pair of discharge electrodes for generating a plasma discharge therebetween;

a scan control circuit for generating a strobe pulse for selecting the discharge channel;

means for providing a first voltage pulse having one polarity with respect to a reference potential to one of the pair of discharge electrodes in the plasma cell;

a constant current circuit for maintaining a plasma discharge current at constant level during discharge selection period; and driving means for providing a second voltage pulse to the other of the pair of the discharge electrodes, the second voltage pulse having an initial potential of reversed polarity of the one polarity at the start of the discharge selection period, the potential decrementing over time and returning to the reference potential before the end of the discharge selection period, wherein one of said pair of discharge electrodes and the other of said pair of discharge electrode are anode and cathode, respectively, the anode being provided with the first voltage pulse which is positive-going, the initial potential being lower than the reference potential.

11. A discharge driving circuit, comprising:

a plurality of nonintersecting channels filled with an ionizable gas, each channel containing a pair of discharge electrodes;

a scan control circuit for generating a strobe pulse for selecting discharge channels;

means for providing a first voltage pulse having one polarity with respect to a reference potential to one of the pair of discharge electrodes;

a constant current circuit for maintaining a discharge current at a constant level during discharge selection period; and means for providing a second voltage pulse to the pair of discharge electrodes, the second voltage pulse having an initial potential of a reversed polarity of the one polarity at the start of the discharge selection period so that a plasma discharge is initiated between the pair of discharge electrodes at the start of the discharge selection period, the potential decrementing over time and returning to the reference potential before an end of the discharge selection period so that the voltage between the pair of discharge electrodes is of a lesser amplitude than the initial potential and is sufficient to maintain the plasma discharge.

12. The discharge driving circuit as claimed in claim 11, wherein the reference potential is a ground potential.

13. The discharge driving circuit as claimed in claim 11, wherein said pair of discharge electrodes are a cathode and anode, respectively.

14. A display device, comprising:

a substrate;

a dielectric;

a liquid crystal layer positioned between said substrate and said dielectric;

said substrate comprises a signal electrode;

plasma cell comprising a discharge channel;

said discharge channel comprises a first discharge electrode and a second discharge electrode;

said liquid crystal layer being superposed on said plasma cell;

scan control circuit for generating a strobe pulse to activate a plasma discharge between said first and second discharge electrodes in said discharge channel for a predetermined discharge selection duration;

control circuit for providing a first voltage pulse of a first polarity, to said first discharge electrode of said plasma cell at a first predetermined time during said discharge selection duration;

said first polarity being determined with respect to a predetermined reference potential; and driver circuit for providing a second voltage pulse to said second discharge electrode of said plasma cell at a second predetermined time during said discharge selection duration to initiate a plasma discharge and gradually decreasing said second voltage pulse to a potential which is substantially equal to said predetermined reference voltage during said discharge selection during to maintain the plasma discharge.

15. A display device according to claim 14, wherein said first electrode of said plasma cell is an anode and said second electrode is a cathode.

16. A display device according to claim 14, wherein said first electrode of said plasma cell is a cathode and said second electrode is an anode.

17. A method of driving a plasma addressed liquid crystal device, comprising the steps of:

activating a discharge channel of a plasma discharge cell for a predetermined discharge selection duration;

providing a first voltage pulse having a first polarity with respect to a predetermined reference potential, to a first electrode of a substrate of a plasma discharge cell, at a first predetermined time during said discharge selection duration;

providing a second voltage pulse of a polarity opposite said first voltage pulse, to a second electrode of said substrate of said plasma discharge cell, at a second predetermined time during said discharge selection duration, said second voltage pulse being of an amplitude sufficient to ignite a plasma discharge between said first and second electrodes;

during said discharge selection duration, gradually decreasing said second voltage pulse to a potential which is substantially equal to said predetermined reference voltage, said predetermined reference voltage being sufficient to maintain the plasma discharge between said first and second electrodes.

18. A display device, comprising:

a tuner for receiving broadcast video signals;

a plasma addressed liquid crystal display for displaying video images represented by said video signals;

said plasma addressed liquid crystal display comprises:

a substrate;

a dielectric;

a liquid crystal layer positioned between said substrate and said dielectric;

said substrate comprises a signal electrode;

plasma cell comprising a discharge channel;

said discharge channel comprises a first discharge electrode and a second discharge electrode;

said liquid crystal layer is superposed on said plasma cell;

scan control circuit for generating a strobe pulse to activate said discharge channel for a predetermined discharge selection duration;

control circuit for providing a first voltage pulse of a first polarity, to said first discharge electrode of said plasma cell at a first predetermined time during said discharge selection duration;

said first polarity is determined with respect to a predetermined reference potential; and driver circuit for providing a second voltage pulse to said second discharge electrode of said plasma cell at a second predetermined time during said discharge selection duration to ignite a plasma discharge and gradually decreasing said second voltage pulse to a potential which is substantially equal to said predetermined reference voltage during said discharge selection duration to maintain the plasma discharge.

19. A display device, comprising:

video reproducing device for reproducing video signals recorded on a predetermined recording medium;

a plasma addressed liquid crystal display for displaying video images represented by said video signals;

said plasma addressed liquid crystal display comprises:

a substrate;

a dielectric;

a liquid crystal layer positioned between said substrate and said dielectric;

said substrate comprises a signal electrode;

plasma cell comprising a discharge channel; said discharge channel comprises a first discharge electrode and a second discharge electrode;

said liquid crystal layer is superposed on said plasma cell;

scan control circuit for generating a strobe pulse to activate said discharge channel for a predetermined discharge selection duration;

control circuit for providing a first voltage pulse of a first polarity, to said first discharge electrode of said plasma cell at a first predetermined time during said discharge selection duration;

said first polarity is determined with respect to a predetermined reference potential; and driver circuit for providing a second voltage pulse to said second discharge electrode of said plasma cell at a second predetermined time during said discharge selection duration to ignite a plasma discharge and gradually decreasing said second voltage pulse to a potential which is substantially equal to said predetermined reference voltage during said discharge selection duration to maintain the plasma discharge.

20. A display device, comprising:

a keyboard for inputting data;

data storage device for storing data;

a plasma addressed liquid crystal display for displaying said plasma addressed liquid crystal display comprises:

a substrate;

a dielectric;

a liquid crystal layer positioned between said substrate and said dielectric;

said substrate comprises a signal electrode;

plasma cell comprising a discharge channel;

said discharge channel comprises a first discharge electrode and a second discharge electrode;

said liquid crystal layer is superposed on said plasma cell;

scan control circuit for generating a strobe pulse to activate said discharge channel for a predetermined discharge selection duration;

control circuit for providing a first voltage pulse of a first polarity, to said first discharge electrode of said plasma a cell at a first predetermined time during said discharge selection duration;

said first polarity is determined with respect to a predetermined reference potential; and driver circuit for providing a second voltage pulse to said second discharge electrode of said plasma cell at a second predetermined time during said discharge selection duration to ignite a plasma discharge and gradually decreasing said second voltage pulse to a potential which is substantially equal to said predetermined reference voltage during said discharge selection duration to maintain the plasma discharge.

* * * * *